US006712591B2

(12) United States Patent
Lee

(10) Patent No.: US 6,712,591 B2
(45) Date of Patent: Mar. 30, 2004

(54) DISCHARGE VALVE OF A HERMETIC COMPRESSOR USING STOPPER AND WEIGHT DRIVEN DISC VALVE

(75) Inventor: Sung-tae Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/141,007

(22) Filed: May 8, 2002

(65) Prior Publication Data

US 2003/0095882 A1 May 22, 2003

(30) Foreign Application Priority Data

Nov. 19, 2001 (KR) ..... 2001-71738

(51) Int. Cl.[7] ..... F04B 53/00

(52) U.S. Cl. ..... 417/569; 417/427; 417/458; 417/569; 139/533.17; 139/543.19; 139/533.19

(58) Field of Search ..... 417/427, 443, 417/446, 458, 559, 569, 570, 426, 428, 429, 431; 137/533.17, 533.19, 533.31, 543.19, 528, 532, 529, 533.21, 533.23

(56) References Cited

U.S. PATENT DOCUMENTS 4,184,818 A * 1/1980 Petrovsky et al. ..... 417/569
5,584,676 A * 12/1996 Dreiman ..... 417/569
5,988,988 A * 11/1999 Tokumasu ..... 417/222.2
6,000,500 A * 12/1999 Oh ..... 184/6.16
6,065,948 A * 5/2000 Brown ..... 418/55.1
6,537,041 B2 * 3/2003 Lee ..... 417/415
2002/0127123 A1 * 9/2002 Lee ..... 417/415

FOREIGN PATENT DOCUMENTS

JP 358024662 A * 2/1983

* cited by examiner

*Primary Examiner*—Justine R. Yu
*Assistant Examiner*—John F. Belena
(74) *Attorney, Agent, or Firm*—Ladas & Parry

(57) ABSTRACT

A discharge valve of a hermetic compressor includes a valve plate disposed on a cylinder head that draws in and discharges refrigerant according to reciprocal movement of a piston, and the discharge valve having a discharge hole formed therein through which refrigerant is discharged, a disc valve disposed adjacent the discharge hole of the valve plate, the disc valve being raised or lowered by the reciprocal movement of the piston and disc valve weight, and a stopper disposed above the disc valve, for guiding the raising and lowering of the disc valve and also for limiting the height to which the disc valve may be raised. The compressor is not subject to overload or over pressurization that may otherwise result from an elastic closing force operating in the valve, and as a result, compression efficiency is increased, while noise is decreased.

9 Claims, 7 Drawing Sheets

DISCHARGE VALVE OF A HERMETIC COMPRESSOR USING STOPPER AND WEIGHT DRIVEN DISC VALVE

BACKGROUND OF THE INVENTION

1. Field of the Invention

The present invention relates generally to a hermetic compressor, and more particularly, to a discharge valve of a hermetic compressor which is installed in a cylinder head and discharges a compressed refrigerant.

2. Description of the Related Art

Generally, a hermetic compressor is employed in equipment using a refrigerant, such as an air conditioner, and a refrigerator, for compressing the refrigerant.

As shown in FIG. 1, a general conventional hermetic compressor comprises a stator 1, a rotor 2 rotating inside the stator 1, a crank shaft 3 revolving with the rotor 2, a piston 5 connected to the crank shaft 3. A connecting rod 4, reciprocates linearly with the revolution of the crankshaft 3. A cylinder 6 forms a compressive chamber 6B, together with the piston 5, and a valve assembly 7 assembled into a cylinder head 6A for controlling the discharge and a suction of the refrigerant.

The valve assembly 7 consists of an intake valve, which opens during an intake stroke when the piston 5 moves to the bottom dead center and closes during a discharge stroke when the piston moves to the top dead center, and a discharge valve, which opens during the discharge stroke and closes during the intake stroke.

Referring to FIG. 2, the discharge valve 10 includes a valve plate 11, a reed valve 13, a stopper 14, and a keeper 16.

The valve plate 11 has an intake hole 8 for refrigerant intake into the chamber 6B (FIG. 1) and a discharge hole 12 for discharging refrigerant. The discharging hole 12 is formed in a recess 11A of the discharge plate 11.

Within the recess 11A are consecutively piled on and installed in sequences the reed valve 13 for opening/closing the discharge hole 12, the stopper 14 for controlling the degree of opening of the reed valve 13, and the keeper 16 for preventing the reed valve 13 and the stopper 14 from separation from the discharge plate 11.

The operation of the conventional hermetic compressor comprising the same structure as that described above is explained hereafter.

When the rotor 2 rotates by the mutual operation of the rotor 2 and the stator 1, the crank shaft 3 assembled together with the rotor 2 revolves. When the crank shaft 3 rotates, the refrigerant is drawn into and discharged as the piston 5 reciprocates rectilinearly inside the cylinder 6 by the reciprocal action of the connecting rod 4 eccentrically assembled at the end of the crank shaft 3.

For the start of a discharge stroke, the piston 5 moves to the bottom dead center and inside the compressive chamber 6B forms a vacuum. Accordingly, the intake valve (not shown) of the intake hole 8 opens by the refrigerant pressure which displaces the valve toward the vacuum and the refrigerant flows into the compressive chamber 6B. At this point, the reed valve 13 (FIG. 2) keeps the discharge hole 12 closed. With the piston 5 at the bottom dead center, the piston 5 moves back to the top dead center and thereby the discharge stroke compresses the refrigerant and discharges it through the discharge hole 12 and into a discharge tube 9 (FIG. 1). During the discharge stroke, the intake valve closes off the intake hole 8 by means of the pressure of the compressed refrigerant whereby the compressed refrigerant is discharged through the discharge hole 12 by the same pressure pushing up the reed valve 13 and the stopper 14.

In addition, when the piston 5 reaches the top dead center, it begins its movement back again to the bottom dead center, the reed valve, which was moved up and open, falls down and closes the discharge hole 12 and continuous suction and discharge of the refrigerant proceed as the intake valve of the intake hole 8 opens.

Accordingly, the hermetic compressor continues the refrigerating cycle of refrigerant intake, compressing the refrigerant and discharging the compressed refrigerant in accordance with the above described process.

However, in the above discharge valve 10, in order for the refrigerant to be discharged during the discharge stroke the discharge hole 12 should be opened by the actions of lifting the reed valve 13 and the stopper 14. In other words, since the force produced by the discharge pressure of the refrigerant should be higher than the total closing force due to the elasticity of the reed valve 13 and the stopper 14 in order for the discharge hole 12 to remain open. Opening of discharge hole 12 allows the refrigerant to discharge, mere and a higher refrigerant pressure than the pressure required for operation of the pressurization of the refrigerant will be required in compressive chamber 6B. When the cylinder 6 is over pressurized, more power is needed to rotate the rotor 2, thereby resulting in the operation of the hermetic compressor in a less efficient state.

Additionally, it is also problematic in that the compressor makes loud noises due to the beating or impulse sounds made by the reed valve 13 hitting the top of the discharge hole 12 due to the elastic closing force of the reed valve 13 and the stopper 14 combination, and in the action of the piston 5 occurring at the time of the intake stroke.

SUMMARY OF THE INVENTION

The present invention has been made to overcome the above-mentioned problems of the prior art, and accordingly, it is an object of the present invention to provide a discharge valve for a hermetic compressor that is quiet and effective as a result of the cylinder not being over-pressurized by compressing and discharging the refrigerant against the weight of the valve itself during the discharge stroke.

Another object of the present invention is to provide a discharge apparatus of a hermetic compressor that is simple in shape, simple to process and assemble by being comprised of a small number of structural elements.

In order to achieve the above objects, according to the present invention a discharge valve of a hermetic compressor is installed in a cylinder head which opens and closes according to the reciprocal movement of a piston moving within the cylinder head, for discharging compressed refrigerant. The discharge valve of the hermetic compressor includes a valve plate disposed on the cylinder head of the hermetic compressor providing intake and discharge of refrigerant according to reciprocal movement of the piston. The discharge valve has a discharge hole formed therein through which refrigerant is discharged, a disc valve disposed above the discharge hole of the valve plate, being raised or lowered by the reciprocal movement of the piston, and a stopper disposed adjacent the disc valve and separated from the discharge hole, for guiding the raising and lowering of the disc valve and also for limiting the height to which the disc valve may be raised to a predetermined range. Alternatively, a hermetic compressor having a cylinder head and a piston for providing sequentially intake and discharge of a refrigerant during an intake/discharge cycle, adjacent to a discharge valve, the discharge valve may comprise a valve plate disposed on the cylinder head including a discharge hole formed therein for discharge of the refrigerant, a disc valve disposed adjacent the discharge hole of the valve plate, so as to cover the discharge hole during a portion of the intake/discharge cycle depending on the pressure developed within the cylinder head by the piston, and a stopper, adjacent to the disc valve and spaced from the discharge hole, including guides for guiding the orientation of the disc valve and a stopper portion for limiting to a predetermined range the reciprocal motion of the disc valve between the disc hole and the stopper portion.

Preferably, the stopper is connected to the valve plate with a space therebetween by a plurality of guiding pins that are standing upright around the discharge hole of the valve plate, to thereby guide the disc valve by point-contact between the disc valve and the guiding pins.

In another embodiment, the stopper is connected to the valve plate with a space therebetween due to supporting members extending downward from two ends of the stopper, for guiding the disc valve by line-contact of the supporting member and an edge of the disc valve. The stopper is connected to the valve plate with a space therebetween due to a supporting member extending downward from one end of the stopper, and has a plurality of guiding pins protruding from the other end of the stopper toward the valve plate for guiding the disc valve.

The stopper preferably comprises at least three guiding pins, one end of each guiding pin being connected to a circumference of the discharge hole of the valve plate in a vertical manner, while on the other end of each guiding pin is formed an extended end for limiting the height to which the disc valve may be raised.

BRIEF DESCRIPTION OF THE DRAWINGS

The aforementioned objects and characteristics of the present invention will be made more apparent by describing a preferred embodiment of the present invention in greater detail with reference to the accompanying drawings, in which.

DETAILED DESCRIPTION OF THE PREFERRED EMBODIMENTS

Figure 1:
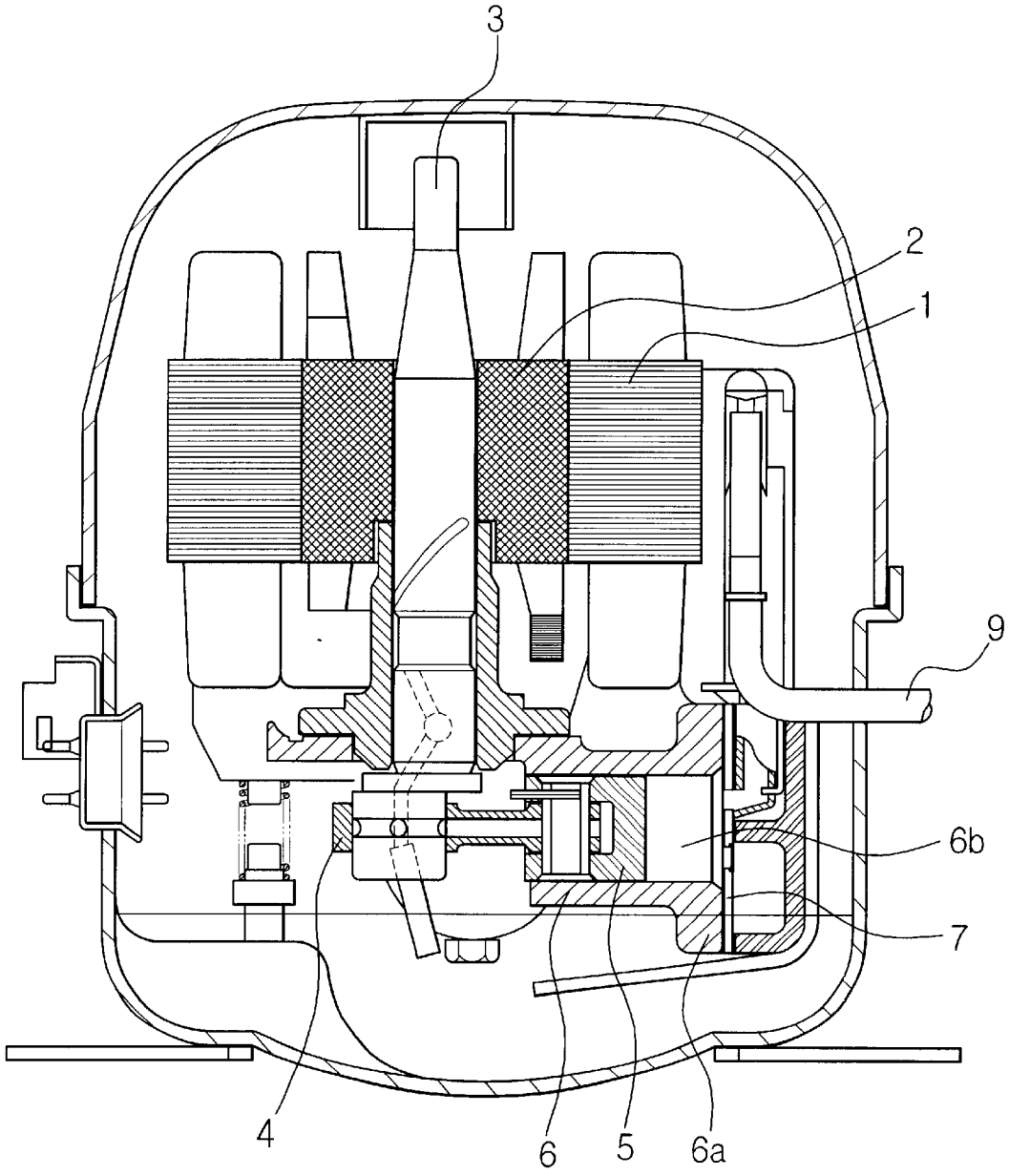
FIG. 1 (PRIOR ART)
FIG. 1 is a sectional side view showing a general conventional hermetic compressor.

Hereinafter, a preferred embodiment of the present invention will be described in greater detail with reference to the accompanying drawings.

Referring to FIGS. 3 to 5B, the discharge valve 100 of a hermetic compressor according to the first embodiment of the present invention includes a valve plate 101, a disc valve 103, a stopper 105 and a number of guiding pins 107.

Figure 2:
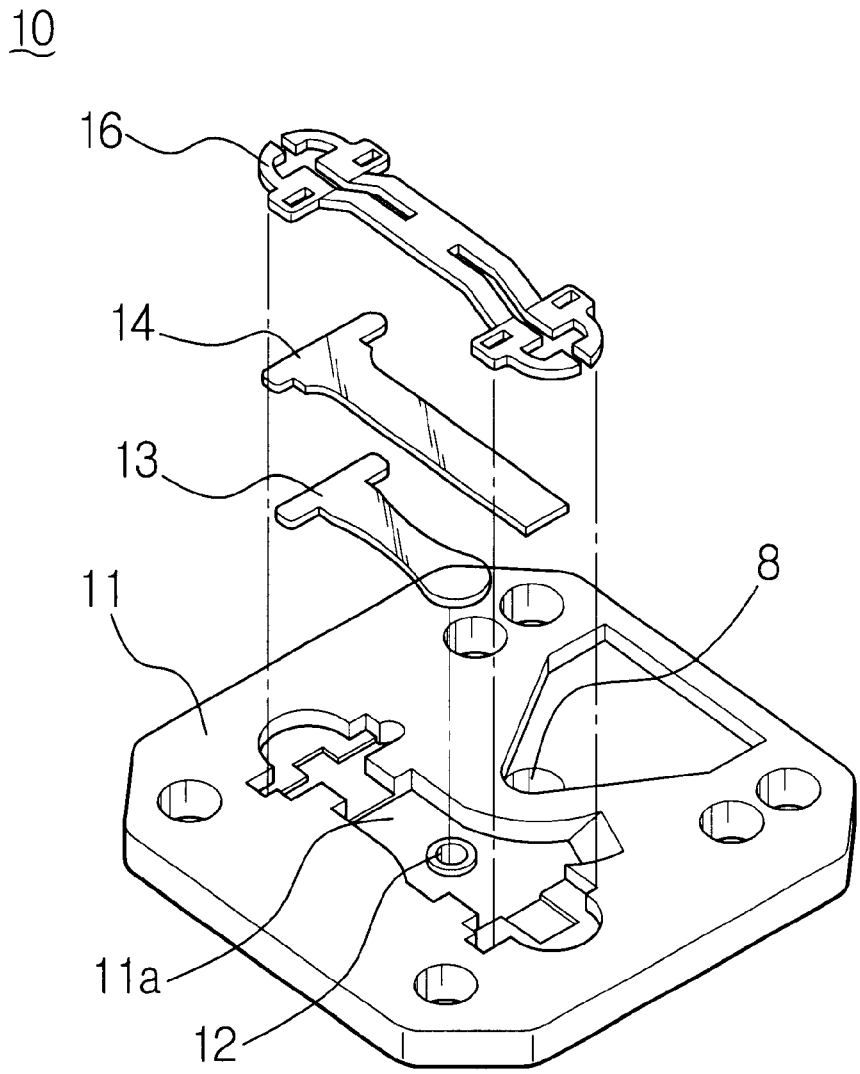
FIG.2 (PRIOR ART)
FIG. 2 is an exploded perspective of a conventional discharge valve.
Figure 3:
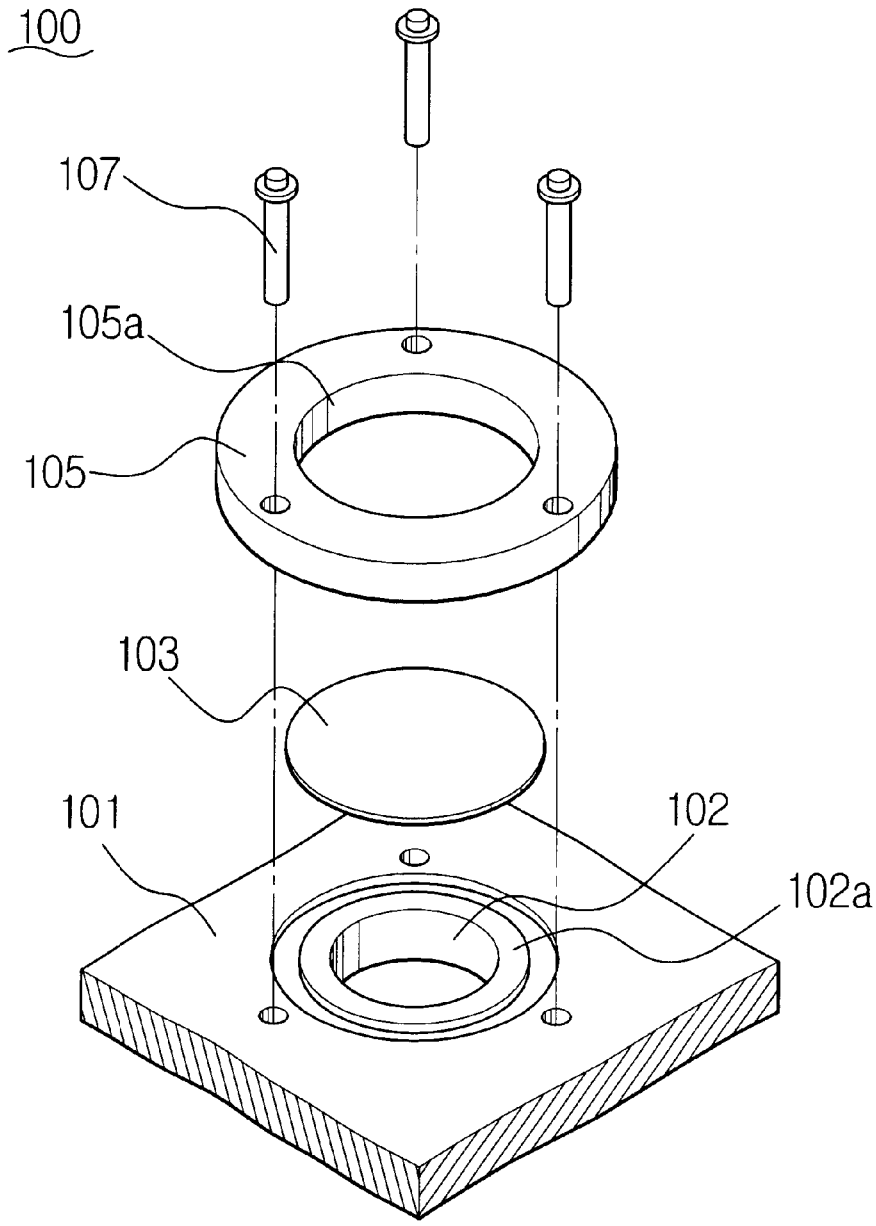
FIG. 3 is an exploded perspective showing the first embodiment of a discharge valve of the hermetic compressor in accordance with the present invention.

The valve plate is disposed on the cylinder head and has a discharge hole 102 for discharging a refrigerant and an intake hole 8 (FIG. 2) for refrigerant intake into the compression chamber. It is preferable that a seating portion 102*a* is formed at the top of the discharge hole 102, as shown, for the disc valve 103 to effectively close the discharge hole 102.

Being located at the top of the discharge hole 102, the disc valve 103, which is used for closing the discharge hole 102, helps the refrigerant to be compressed by closing the discharge hole with its own weight at the time of the discharge stroke and helps the refrigerant to be discharged as the disc valve 103 is raised by the pressure when the compressive force inside the cylinder exceeds the disc valve weight. Preferably the disc valve 103 is shaped and dimensioned to be bigger than the diameter of the discharge hole 102 so that it can close the discharge hole 102 and may take the shape of a disc, although it is preferred that the shape corresponds to the shape of the discharge hole 102.

The stopper 105 is disposed on the top of the discharge valve 103 of the discharge hole 102 and restricts the height the disc valve 103 can be raised when the disc valve 103 is raised by the pressure of the refrigerant during the discharge stroke. Additionally, the middle of the stopper has a through hole 105A communicating with the discharge hole 102 for smooth flow of the discharged refrigerant.

Figure 4A:
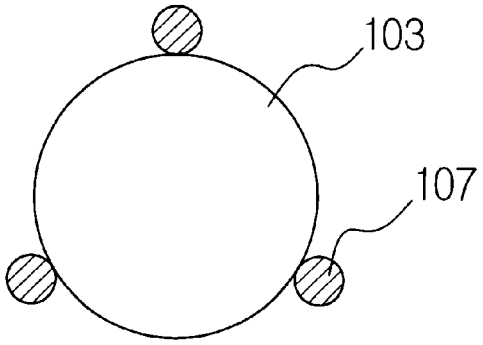
FIG. 4A is a sectional view showing the disc valve of FIG. 3 being guided by three guiding pins.
Figure 4B:
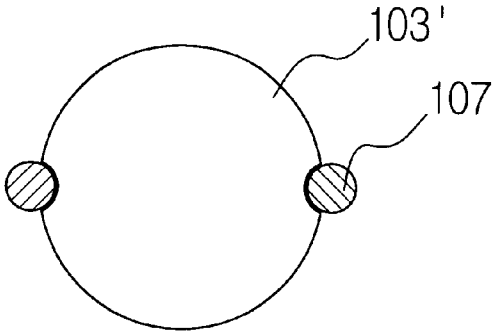
FIG. 4B is a sectional view showing the disc valve of FIG. 3 being guided by two guiding pins.
Figure 5A:
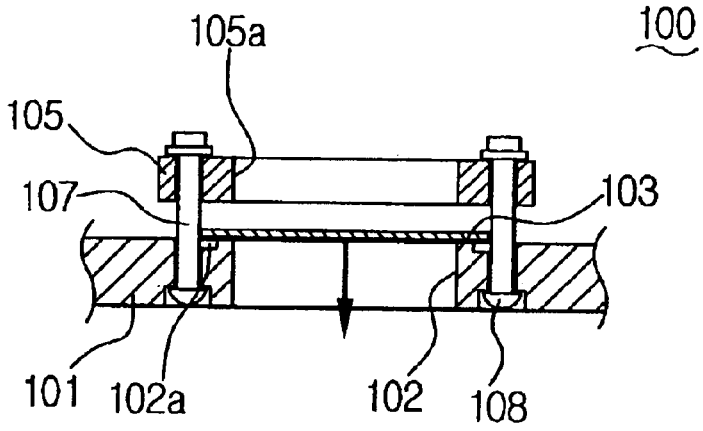
FIG. 5A is a cross-sectional view showing the discharge valve of FIG. 3 in a closed position.
Figure 5B:
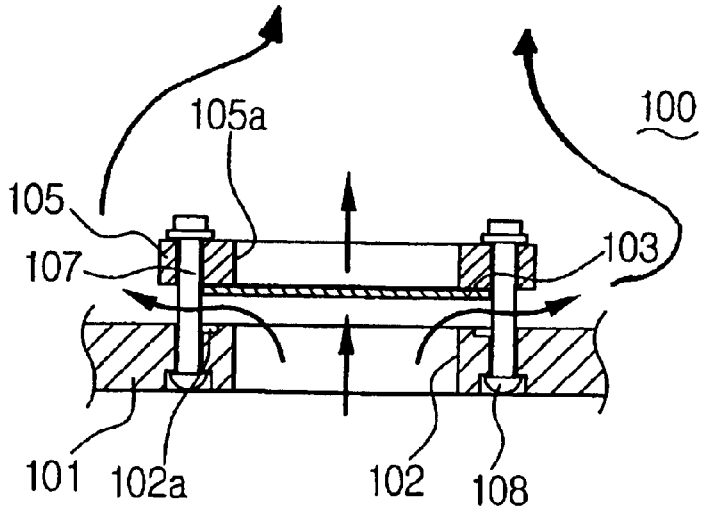
FIG. 5B is a cross-sectional view showing the discharge valve of FIG. 3 in an open position.

Each guiding pin 107, having a cylindrical shape, fastens the stopper to the valve plate 105 so that the stopper can be attached at a predetermined distance from the valve plate 105. The guiding pins 107 guide the disc valve 103 during the raising and lowering movements. The method of fastening the guiding pins 107 to the valve plate 101 can take various forms, including welding, but riveting 108, as shown in FIGS. 5A and 5B, is preferable. In addition, for the guiding pin 107 to guide the raising and lowering movement stably and by engaging the disc 103 in point-contact, at least three guiding pins 107 are needed, as shown in FIG. 4A. Undoubtedly, in the case of the alternative shape of the disc valve 103' being as that shown in FIG. 4B, two guiding pins 107 only can stably guide the raising and lowering movement of the disc valve 103'.

The movement of the discharge valve in the first embodiment having the above described structure is described below.

Referring now to FIGS. 5A and 5B, when the piston moves to the bottom dead center during the intake stroke, the discharge valve is opened by the force of the fluid pressure acting on the discharge valve, not met by a counterforce because of the vacuum formed in the cylinder, and the refrigerant is drawn into the cylinder. At the same time, the disc valve 103 drops down by the force of the pressure of the fluid acting against disc valve 103, causing it to move toward the vacuum and as a result of the weight of the disc valve 103 being attracted downwardly by gravity to close the discharge hole 102, as shown in FIG. 5A.

When the piston reaches the bottom dead center, it starts to compress the refrigerant while moving back to the top dead center. If the compressive pressure force developed by the piston on the disc valve 103 exceeds the weight of the disc valve 103, the disc valve 103 will lift along the guiding pins 107. As the disc valve 103 is lifted, its movement is stopped by the stopper 105, as shown in FIG. 5B, and the compressed refrigerant being discharged through the discharge hole 102 is discharged through the space between the disc valve 103 and the valve plate 101 and finally out through the discharge tube 9 (FIG. 1).

During the discharge stroke, since the piston moves back to the bottom dead center and starts the intake stroke when it reaches the top dead center, intake and discharge of the refrigerant continue.

As the disc valve 103 is guided by the three guiding pins and engages them in point-contact during the discharge and intake stroke, it can stably open and close the discharge hole 102.

Figure 6:
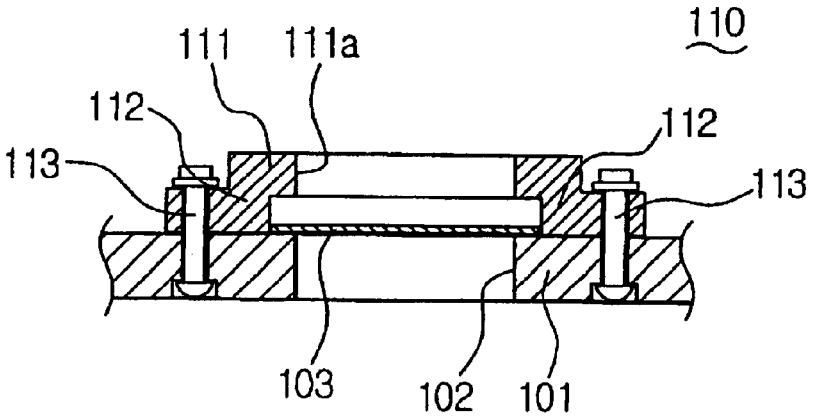
FIG. 6 is a cross-sectional view showing a second embodiment of the hermetic compressor according to the present invention.

The discharge valve 110 of the hermetic compressor according to a second embodiment of the present invention, shown in FIG. 6, is essentially identical to the hermetic compressor 100, according to the first embodiment, except for having supporting members connected to the lower part of the stopper, instead of a connection provided by the guiding pins 107. The supporting members help the stopper keep its predetermined distance and also to guide the disc valve 103. In FIG. 6, the supporting members 112 are fastened to the valve plate 101 by the rivets 113, but the method for fastening the supporting members 112 can take various forms, including welding. Cantilevered sections of the supporting members 112 form a stopper 111 that define a through hole 111*a* provided at the stopper.

The movement of the discharge valve 110 according to the second embodiment is identical to that of the first embodiment except that the disc valve 103 is guided by line-contact with the inner surface of the supporting members 112 and the remaining operation steps therefore will not be described in detail. It should be noted that the cross-section view shown in FIG. 6 is taken through two oppositely disposed supporting members 112, separated by fluid communication operatures (not shown), that support the stopper 111 in the form of a collar or annular ring.

Figure 7:
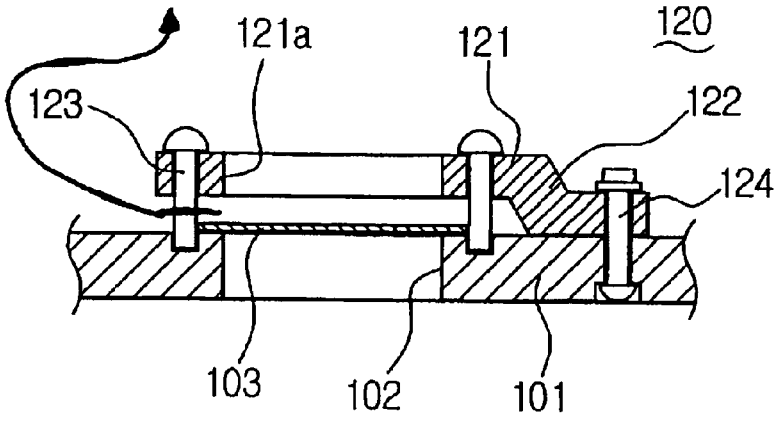
FIG. 7 is a cross-sectional view showing a third embodiment of the hermetic compressor according to the present invention.

Additionally, the discharge valve according to a third embodiment of the present invention is shown in FIG. 7.

The discharge valve 120 according to the third embodiment is comprised of a valve plate 101 having a discharge hole 102, a disc valve 103 opening and closing the discharge hole 102 according to the reciprocating movement of a piston, and a canti-levered stopper 121 restricting the height to which the disc valve 103 may be raised.

One end of the stopper 121 is fastened at a predetermined distance from the valve plate 101 by the supporting members 122 which extend toward the valve plate 101 by the cantilevered section. The fastening means for the supporting members 112 can include welding, as well as riveting 124, which is shown in FIG. 7.

In addition, the other end of the stopper has a number of guiding pins 123 that can guide the disc valve 103. The guiding pins 123 protrude toward the valve plate 101 and the inner space of the circle formed by the guiding pins 123 defines a through hole 121*a*.

The detailed description of the third embodiment having the above structure will be omitted as it is identical to the first embodiment except that the guiding pins 123 only function for guiding the disc valve 103 and the supporting members 122 of the stopper 121 limit the height to which the disc valve 103 may be raised.

Figure 8:
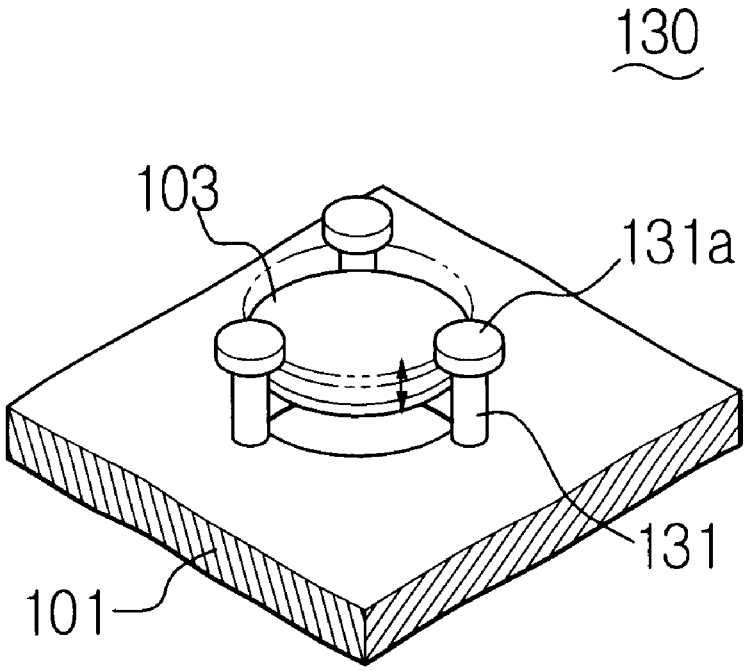
FIG. 8 is a perspective view showing a fourth embodiment of the hermetic compressor according to the present invention.

Referring to FIG. 8, the discharge valve 130 hermetic compressor according to a fourth embodiment of the present invention has an identical structure to that of the first embodiment 100 except that the stopper is provided by the guiding pins 131 having extended end portions 131*a*.

In the fourth embodiment 130, the height to which the disc valve 103 may be raised is determined by the height of the extended end portion of the guiding pins 131 measured from the surface of the valve plate 101, and the raising and lowering movements of the disc valve 103 are guided by the contact with guiding pins. Two guiding pins 131 may be sufficient but three are preferable.

According to the discharge valve of the hermetic compressor according to the present invention, as described above, the weight of the disc valve 103 only is applied in opening and closing the discharge hole 102 and the piston will not be over pressurized at the time of discharge since the elastic closing force of the reed valve 13 and the stopper 14 combination, as in the conventional compressor, are not utilized in the present invention.

In addition, at the time of the intake stroke when the disc valve 103 closes the discharge hole 102, the noise is reduced as the beating sounds are reduced because the top of the discharge hole 102 is beaten only by the intake force and the weight of the disc valve 103.

Also, the ease of manufacture and assembly and reliability of the products increase in comparison to the conventional discharge valve as the discharge valve simply comprises the disc valve 103 and the stopper 105.

As described above, according to the discharge valve of the hermetic compressor of the present invention, the efficiency of the hermetic compressor can be improved as the disc valve 103 opens and closes the discharge valve by its own weight and the piston will not be over pressurized at the time of the discharge.

Additionally, the noises made by the beating sounds from the discharge hole are reduced as the discharge hole is opened and closed by the weight of the disc valve 103 and the force of intake motion only.

In addition, the ease of manufacture and assembly and reliability of the products increase as the shape of the discharge valve is simplified to a disc shape and a number of structural elements are eliminated.

Although the preferred embodiments of the present invention have been described, it will be understood by those skilled in the art that the present invention should not be limited to the described preferred embodiments. Various changes and modifications can be made while utilizing the present invention, meanwhile remaining within the spirit and scope of the present invention, as defined by the appended claims.

What is claimed is:

1. A discharge valve for a hermetic compressor, comprising:

a valve plate disposed on a cylinder head of the hermetic compressor allowing intake and discharge of refrigerant according to reciprocal movement of a piston, the valve plate having a discharge hole formed therein through which refrigerant is discharged;

a non-curved in cross-section disc valve disposed above the discharge hole of the valve plate, being raised by the pressure of the refrigerant caused by the reciprocal movement of the piston and lowered by its own weight; and a non-curved in cross-section stopper disposed above the disc valve, for limiting height to which the disc valve may be raised to a predetermined range, wherein the stopper is connected to the valve plate by a plurality of guiding pins for guiding the raising and lowering of the disc valve with an open space there between defined by the guiding pins disposed upright around the discharge hole of the valve plate, the plurality of guiding pins guiding the disc valve by point-contact between the guiding pins and the disc valve.

2. A discharge valve for a hermetic compressor, comprising:

a valve plate disposed on a cylinder head of the hermetic compressor allowing intake and discharge of refrigerant according to reciprocal movement of a piston, the valve plate having a discharge hole formed therein through which refrigerant is discharged;

a non-curved in cross-section disc valve disposed above the discharge hole of the valve plate, being raised or lowered by the pressure of the refrigerant caused by the reciprocal movement of the piston; and a non-curved in cross-section stopper disposed above the disc valve, for limiting height to which the disc valve may be raised to a predetermined range, wherein the stopper is connected to the valve plate by a plurality of guiding pins with an open space there between defined by the supporting members extending downward from two ends of the stopper, the supporting members guiding the disc valve by line-contact between the supporting member and the disc valve.

3. The discharge valve of claim 1, wherein the stopper is further connected to the valve plate by a supporting member extending downward from one end of the stopper, and plurality of guiding pins protruding from the other end of the stopper and extending toward the valve plate for guiding the disc valve.

4. The discharge valve of claim 1, wherein the stopper has a center and including an opening formed in its center, the central position of the opening corresponding to the central position of the discharge hole.

5. The discharge valve of claim 1, wherein the stopper is connected to the valve plate by at least three guiding pins, one end of each of said at least three guiding pins being connected to a circumference of the discharge hole of the valve plate in a vertical manner, while on the other end of each guiding pin there is formed an extended end for limiting a range of raising movement of the disc valve.

6. A hermetic compressor having a cylinder head and a piston for providing sequentially intake and discharge of a refrigerant during an intake/discharge cycle, adjacent to a discharge valve, the discharge valve comprising:

a) a valve plate disposed on the cylinder head including a discharge hole formed therein for discharge of the refrigerant;

b) a non-curved in cross-section disc valve disposed adjacent the discharge hole of the valve plate, so as to cover the discharge hole during a portion of the intake/discharge cycle depending on the pressure developed within the cylinder head by the piston; and c) a non-curved in cross-section stopper, adjacent to the disc valve and spaced apart from the discharge hole, including a plurality of guides for guiding orientation of the disc valve and a stopper portion for limiting to a predetermined range a reciprocal motion of the disc valve between the discharge and the stopper portion, wherein the stopper is connected to the valve plate by a plurality of guides with an open space therebetween defined by the guides being disposed upright around the discharge hole of the valve plate, the plurality of guides guiding the disc valve by point-contact between the plurality of guides and the disc valve.

7. A hermetic compressor having a cylinder head and a piston for providing sequentially intake and discharge of a refrigerant during an intake/discharge cycle, adjacent to a discharge valve, the discharge valve comprising:

a) a valve plate disposed on the cylinder head including a discharge hole formed therein for discharge of the refrigerant;

b) a non-curved in cross-section disc valve disposed adjacent the discharge hole of the valve plate, so as to cover the discharge hole during a portion of the intake/discharge cycle depending on the pressure developed within the cylinder head by the piston; and c) a non-curved in cross-section stopper, adjacent to the disc valve and spaced apart from the discharge hole, including a plurality of guides for guiding orientation of the disc valve and a stopper portion for limiting to a predetermined range the reciprocal motion of the disc valve between the disc hole and the stopper portion, wherein the stopper is connected to the valve plate by supporting members extending downward from two ends of the stopper, the supporting members defining an open space and guiding the disc valve by line-contact between the supporting member and the disc valve.

8. The hermetic compressor of claim 6, wherein the stopper is further connected to the valve plate by a supporting member extending downward from one end of the stopper, and the plurality of guides protruding from the other end of the stopper and extending toward the valve plate for guiding the disc valve, wherein the stopper has a center and including an opening formed in its center, the central position of the opening corresponding to the central position of the discharge hole.

9. The hermetic compressor of claim 6, wherein the stopper is connected to the valve plate by at least three guides, one end of each guide being connected to the valve plate in a circumference centered at the discharge hole of the valve plate in a vertical manner, while on the other end of each guide there is formed an extended end for limiting a range of raising movement of the disc valve.

* * * * *